US008936049B2

(12) United States Patent
Sledzinski

(10) Patent No.: US 8,936,049 B2
(45) Date of Patent: Jan. 20, 2015

(54) POWER TOOL FOR STAINLESS STEEL METAL LOCKING TIES

(71) Applicant: Panduit Corp., Tinley Park, IL (US)

(72) Inventor: Bon B. Sledzinski, Westmont, IL (US)

(73) Assignee: Panduit Corp., Tinley Park, IL (US)

( * ) Notice: Subject to any disclaimer, the term of this patent is extended or adjusted under 35 U.S.C. 154(b) by 6 days.

(21) Appl. No.: 13/941,609

(22) Filed: Jul. 15, 2013

(65) Prior Publication Data

US 2013/0327438 A1 Dec. 12, 2013

Related U.S. Application Data

(63) Continuation of application No. 12/331,916, filed on Dec. 10, 2008, now abandoned.

(51) Int. Cl.

| | |
|---|---|
| ***B21F 9/02*** | (2006.01) |
| ***B65B 13/02*** | (2006.01) |
| ***B65B 13/28*** | (2006.01) |
| ***B65B 13/18*** | (2006.01) |

(52) U.S. Cl.

CPC ..... *B65B 13/185* (2013.01); *B65B 13/027* (2013.01)

USPC ..... 140/93.2; 140/93 R; 140/113; 140/123; 140/123.6

(58) Field of Classification Search

USPC ..... 140/1, 2, 74, 84, 93 R, 93.2, 93.4, 93 A, 140/93 C, 93 D, 111, 113, 123, 123.6, 139, 140/150; 53/399, 417, 136.5; 100/6, 29, 32, 100/33 PB, 2

See application file for complete search history.

(56) References Cited

U.S. PATENT DOCUMENTS

| | | | | |
|---|---|---|---|---|
| 3,661,187 | A | 5/1972 | Caveney et al. | |
| 3,891,012 | A | 6/1975 | Bakermans | |
| 4,371,010 | A | 2/1983 | Hidassy | |
| 4,934,416 | A | 6/1990 | Tonkiss | |
| 5,163,482 | A | 11/1992 | Wolcott | |
| 5,167,265 | A | 12/1992 | Sakamoto | |
| 5,205,328 | A * | 4/1993 | Johnson et al. | 140/93.2 |
| 5,417,252 | A | 5/1995 | Kurmis | |
| 5,417,254 | A | 5/1995 | Kurmis | |
| 5,934,341 | A | 8/1999 | Thieme | |
| 6,024,136 | A | 2/2000 | Wada et al. | |
| 6,481,467 | B2 | 11/2002 | Czebatul et al. | |
| 6,601,616 | B1 | 8/2003 | Lenox | |

(Continued)

FOREIGN PATENT DOCUMENTS

| | | | |
|---|---|---|---|
| EP | 1338513 | A1 | 8/2003 |
| WO | 2008094078 | A2 | 8/2008 |

OTHER PUBLICATIONS

Hayata website pages showing tools for steel cable ties, 2006, 2 pages. http://www.sscableties.com/tools-st.htm.

*Primary Examiner* — Shelley Self
*Assistant Examiner* — Justin V Lewis
(74) *Attorney, Agent, or Firm* — Christopher S. Clancy; Aimee E. McVady

(57) ABSTRACT

A power tool for installing a metal locking tie is disclosed. The power tool includes a body and a power chassis. The body of the tool includes a gear carrier, a tensioning mechanism and a cutting mechanism. The gear carrier is positioned in the tool body and the tensioning mechanism is mounted in the gear carrier. The cutting mechanism engages the gear carrier. As the tie is tensioned, the gear carrier moves linearly in the tool body to cut the tensioned tie.

9 Claims, 12 Drawing Sheets

(56) References Cited

U.S. PATENT DOCUMENTS

| | | | | |
|---|---|---|---|---|
| 7,048,015 | B2 | 5/2006 | Lenox | |
| 7,082,968 | B2 | 8/2006 | Kurmis | |
| 2002/0129866 | A1* | 9/2002 | Czebatul et al. | 140/123.6 |
| 2005/0111995 | A1 | 5/2005 | Everson | |
| 2007/0089801 | A1* | 4/2007 | Hillegonds et al. | 140/93.4 |
| 2008/0006341 | A1* | 1/2008 | Kusakari et al. | 140/118 |
| 2008/0006441 | A1* | 1/2008 | Yamagata et al. | 174/260 |

* cited by examiner

POWER TOOL FOR STAINLESS STEEL METAL LOCKING TIES

CROSS REFERENCE TO RELATED APPLICATION

This application is a continuation of U.S. application Ser. No. 12/331,916, filed Dec. 10, 2008, the subject matter of which is hereby incorporated herein by reference in its entirety.

FIELD OF THE INVENTION

The present invention relates to a power tool for stainless steel metal locking ties, and more particularly to a power tool for stainless steel metal locking ties having a power source to tension the locking tie and to cut the locking tie.

BACKGROUND OF THE INVENTION

As is well known to those skilled in the art, cable ties or stra are used to bundle or secure a group of articles such as electrical wires and cables. Cable ties of conventional construction include a cable tie head and an elongated tail extending therefrom. The tail is wrapped around a bundle of articles and thereafter inserted through the passage in the head. The head of the cable tie typically supports a locking element, which extends into the head passage and engages the body of the tail to secure the tail to the head.

In practice, the installer manually places the tie about the articles to be bundled and inserts the tail through the head passage. At this point, a cable tie installation tool is used to tension the tie to a predetermined tension. The tools of the prior art, although capable of tensioning and thereafter severing the excess portion of the cable tie, typically have several disadvantages therewith. As a result, it is desirable to provide an improved metal tie tool having a single power source for tensioning and cutting the locking tie.

SUMMARY OF THE INVENTION

The present invention is directed towards a power tool for installing a metal locking tie. The tool includes a body and a power chassis. A gear carrier is positioned in the body and a tensioning mechanism is mounted in the gear carrier. A cutting mechanism is also positioned in the tool body and positioned to engage the gear carrier. As the tie is tensioned, the gear carrier moves linearly in the tool body to cut the tensioned tie.

DETAILED DESCRIPTION

Figure 1:
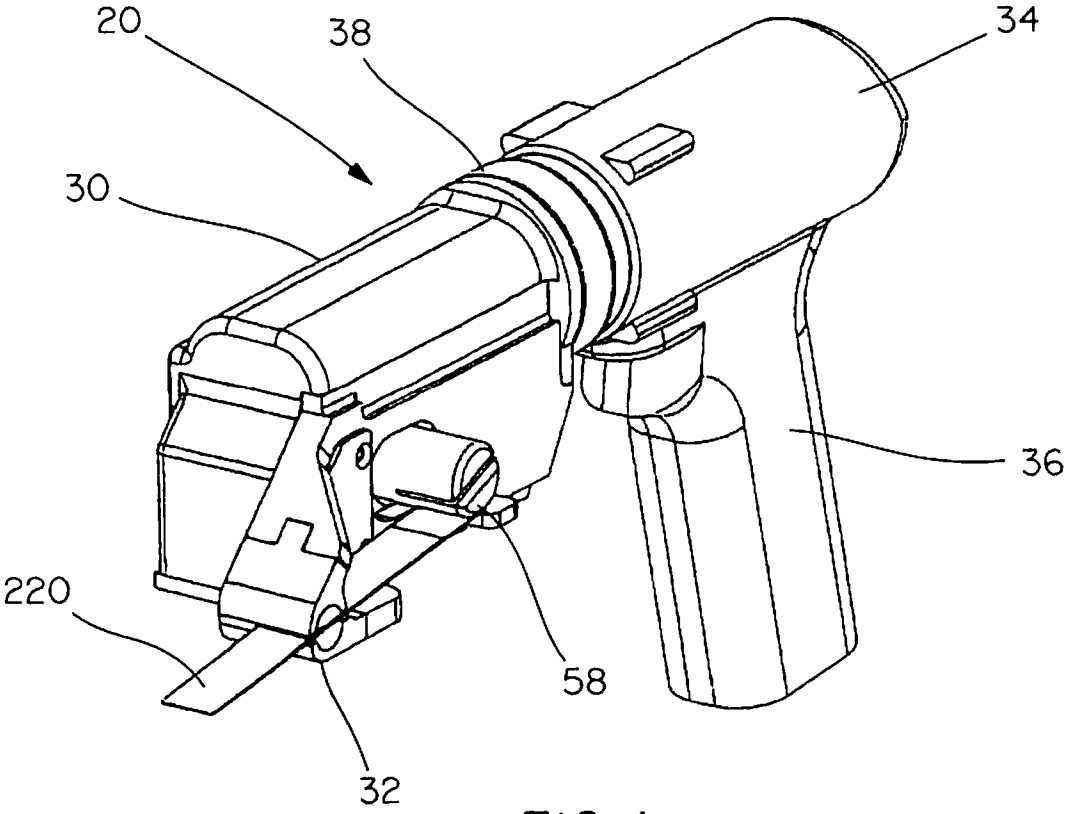
FIG. 1 is a front left side perspective view of the power tool for stainless steel metal locking ties of the present invention.

FIG. 1 illustrates the portable power tool 20 for stainless steel metal locking ties 220 of the present invention. As discussed below, the power tool 20 includes an adjustable tension setting and an automatic cut-off mechanism operated by the same power source. The tool 20 has a tool body 30 with a nose 32 at the front of the tool body 30, a power chassis 34 for housing a battery and a handle 36. The tool body 30 is attached to the power chassis 34 by a swivel connector 38. The swivel connector 38 enables the tool body 30 and the power chassis 34 to be rotated with respect to one another for ease of use. As a result, the operator may rotate the tool body 30 to position the tool at different angles to install the stainless steel locking ties.

The tool body 30 also includes a worm 52, a worm gear 54, a worm gear shaft 56 and a mandrel 58 for tensioning the stainless steel locking tie 220 (see FIGS. 9*a*-13). The tool nose 32 includes a cutting mechanism 200 for cutting the stainless steel locking tie 220 (see FIGS. 9*b*-13).

Figure 2:
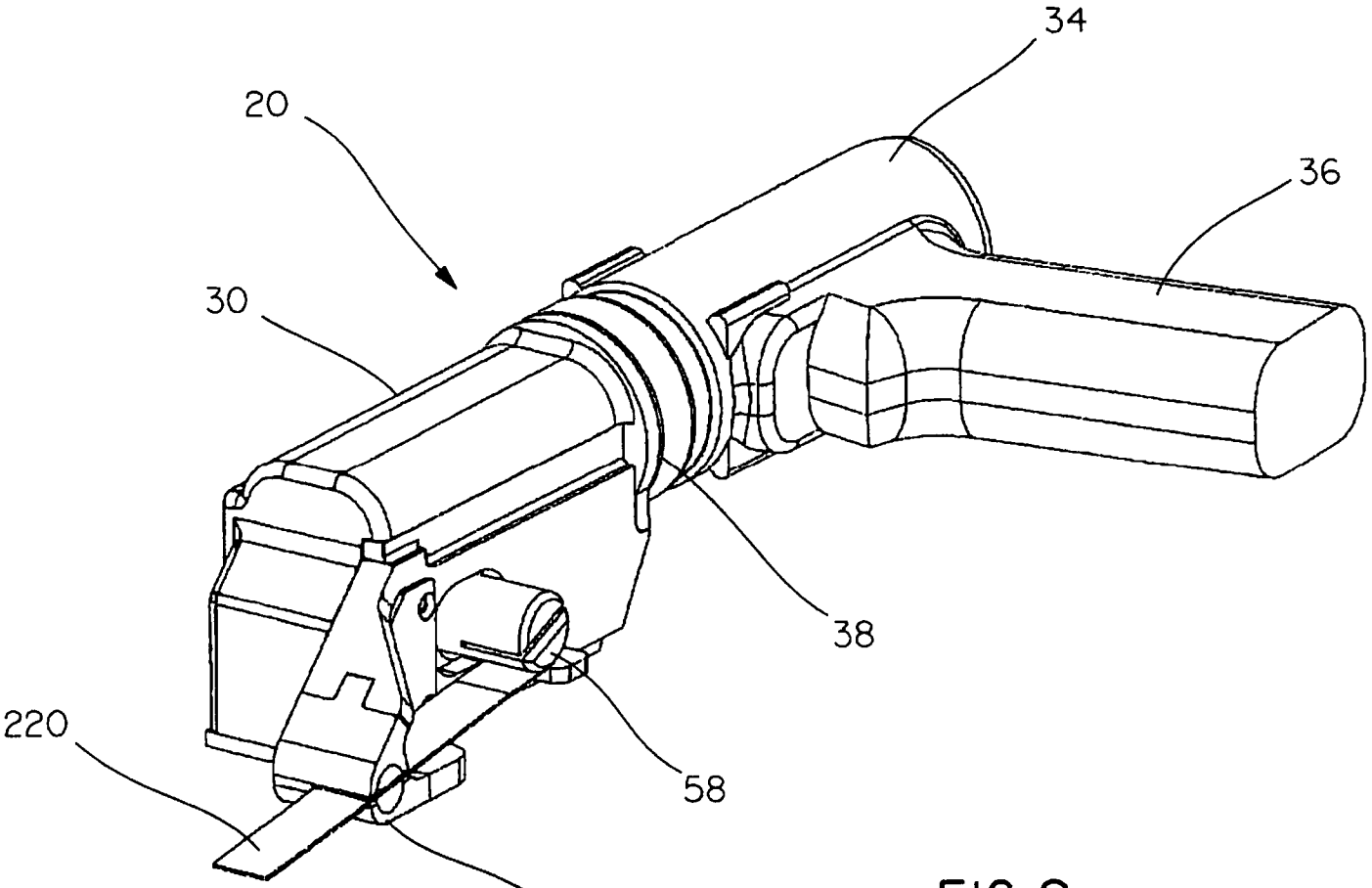
FIG. 2 is a front left side perspective view of the power tool for stainless steel metal locking ties of FIG. 1 with the tool in a rotated position.
Figure 3:
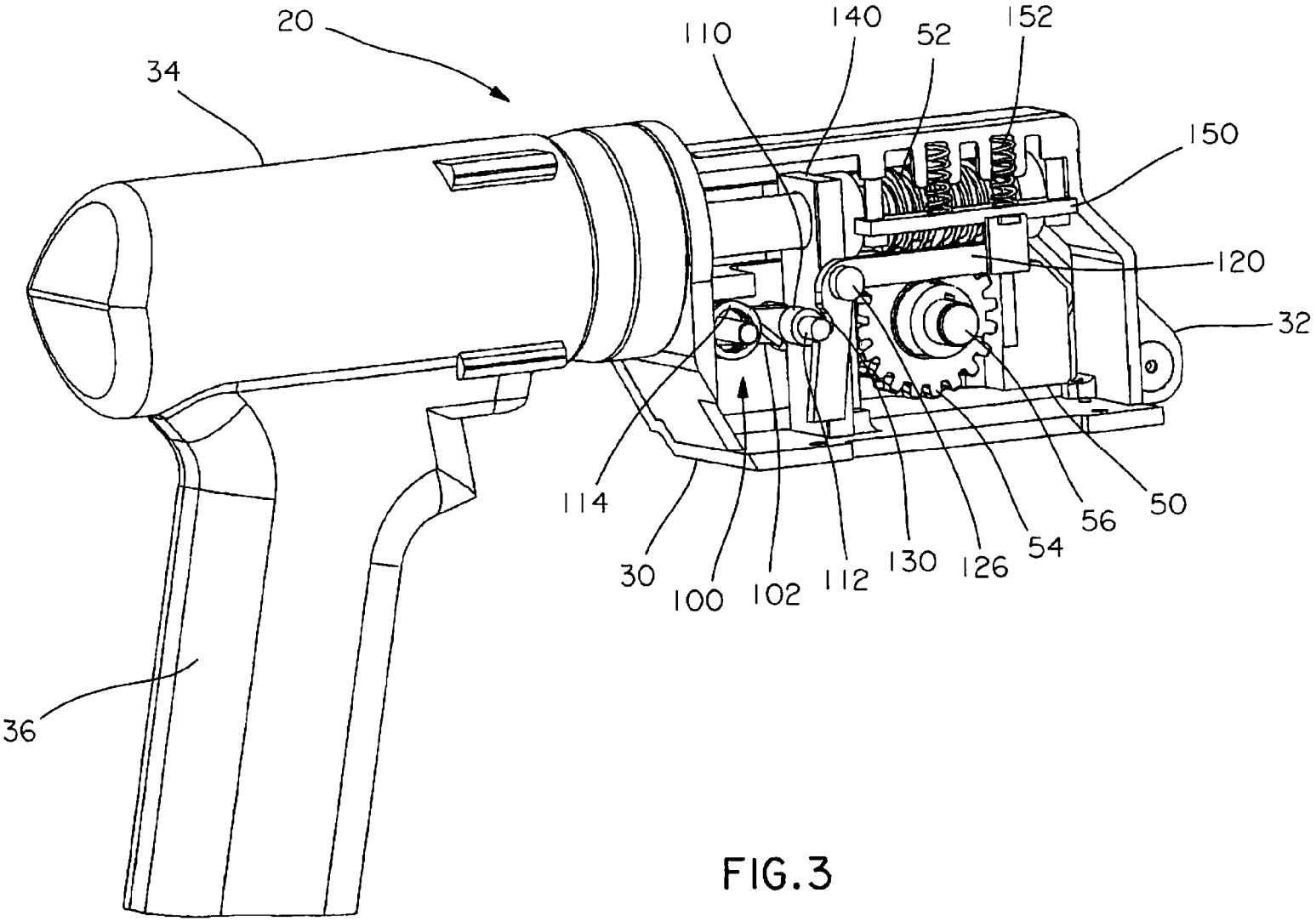
FIG. 3 is a right side perspective view of the power tool of FIG. 1 with a portion of the tool removed.
Figure 9A:
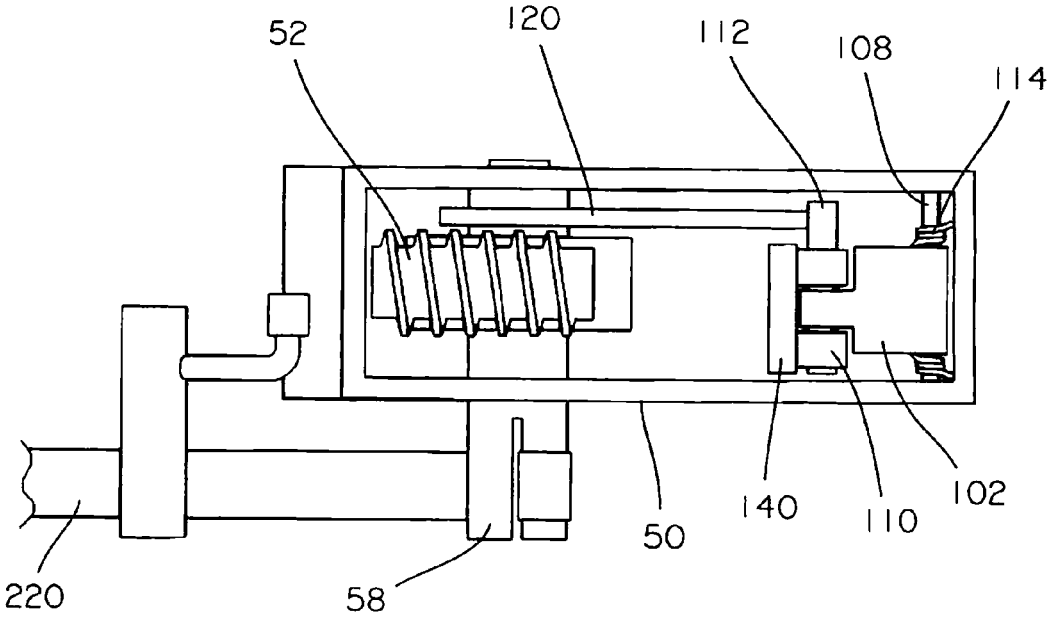
FIG. 9*a* is a top view of the gear carrier and the toggle mechanism of FIG. 3.

As illustrated in FIGS. 3-6, the tool 20 includes a gear carrier 50 which moves linearly in the tool body 30 along a carrier guide 51 toward the nose 32 of the tool 20. The worm 52 is mounted on the worm shaft 53 (see FIG. 6). The worm shaft 53 is mounted in the tool body 30 and ends in a hexagonal driver which fits into the output shaft of the power chassis 34 (not shown). The worm gear 54, worm gear shaft 56 and mandrel 58 are mounted in the gear carrier 50 and positioned such that the worm 52 engages the worm gear 54. As illustrated in FIG. 9*a,* the mandrel 58 is part of the worm gear shaft 56. As illustrated in FIGS. 1-3, the gear carrier 50 with the worm gear 54 and worm gear shaft 56 are housed in the tool body 30 while the mandrel 58 extends from the tool body 30.

Figure 7:
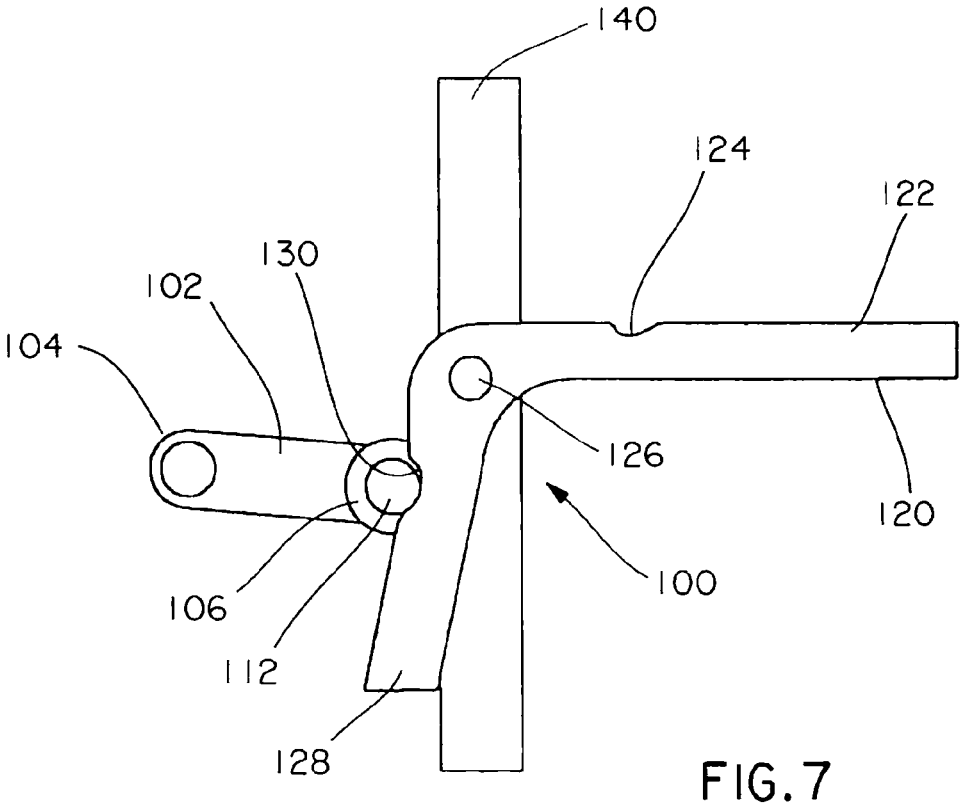
FIG. 7 is a side perspective view of the toggle mechanism of FIG. 4.

The gear carrier 50 can move linearly toward the front of the tool, but is held in place in the tool body 30 by a spring loaded toggle mechanism 100 (see FIG. 7). The toggle mechanism 100 includes a toggle link 102 with a torsion spring 114 (see FIGS. 3 and 4) and a lever arm 120 with a lever arm pivot 126. The lever arm pivot 126 is fixed in the stationary plate 140. The lever arm 120 is generally L-shaped with a horizontally extending portion 122 and a generally vertically extending portion 128. The lever arm pivot 126 is located at the intersection of the horizontally extending portion 122 and the vertically extending portion 128. The vertically extending portion 128 includes a detent pocket 130.

Figure 4:
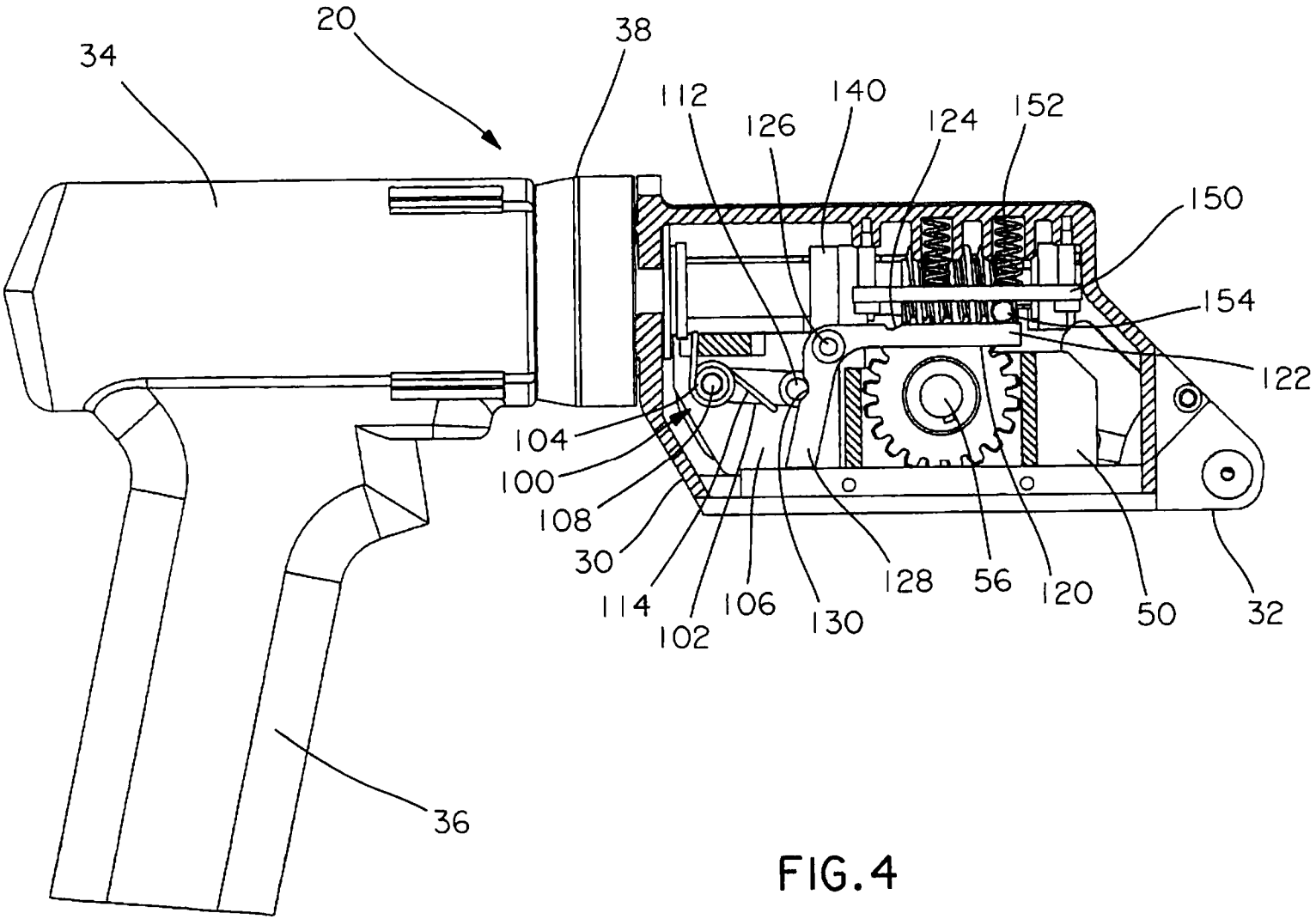
FIG. 4 is a right side view of the power tool of FIG. 3.
Figure 5:
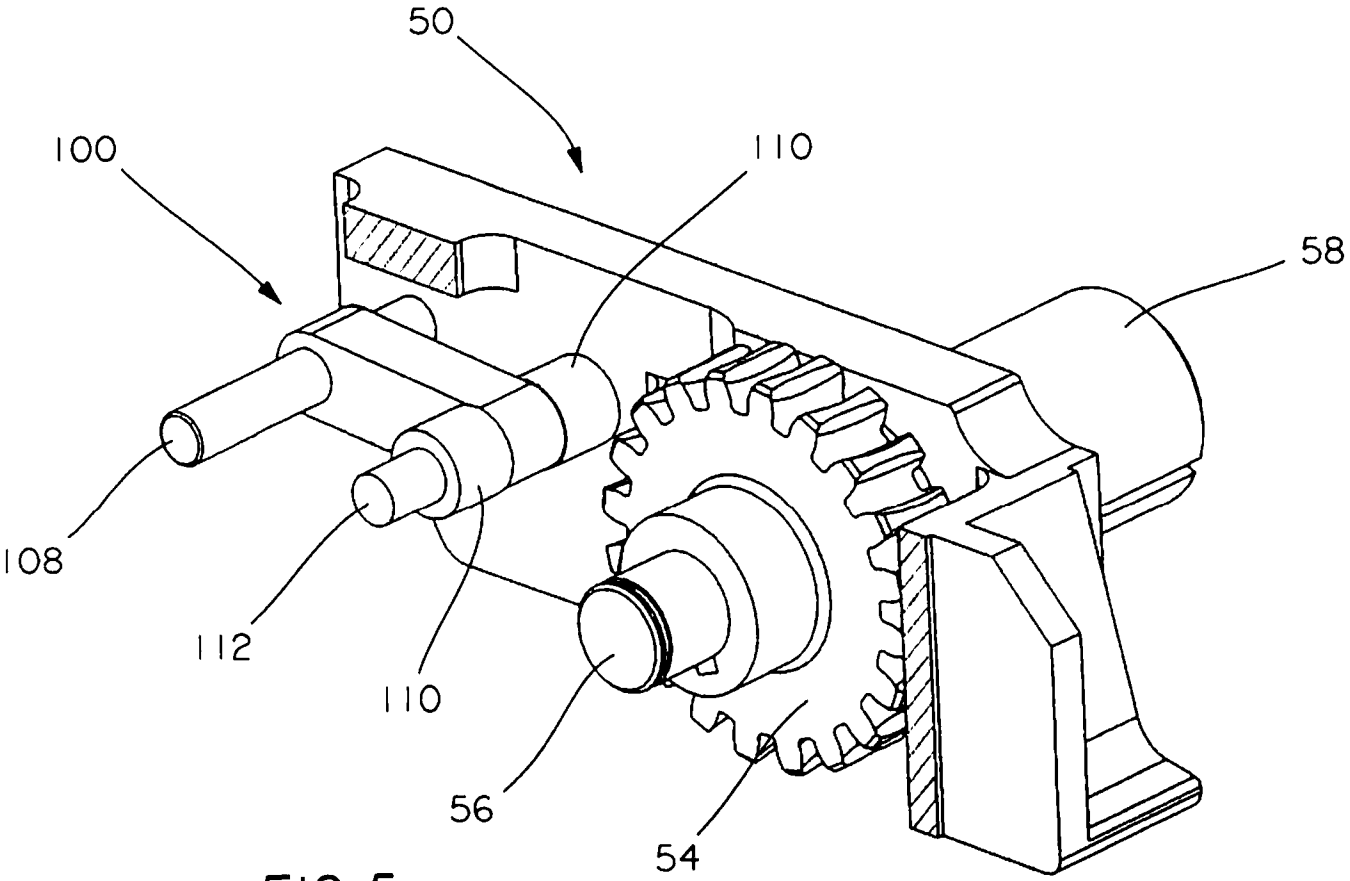
FIG. 5 is a front perspective view of the gear carrier in the power tool of FIG. 3.
Figure 6:
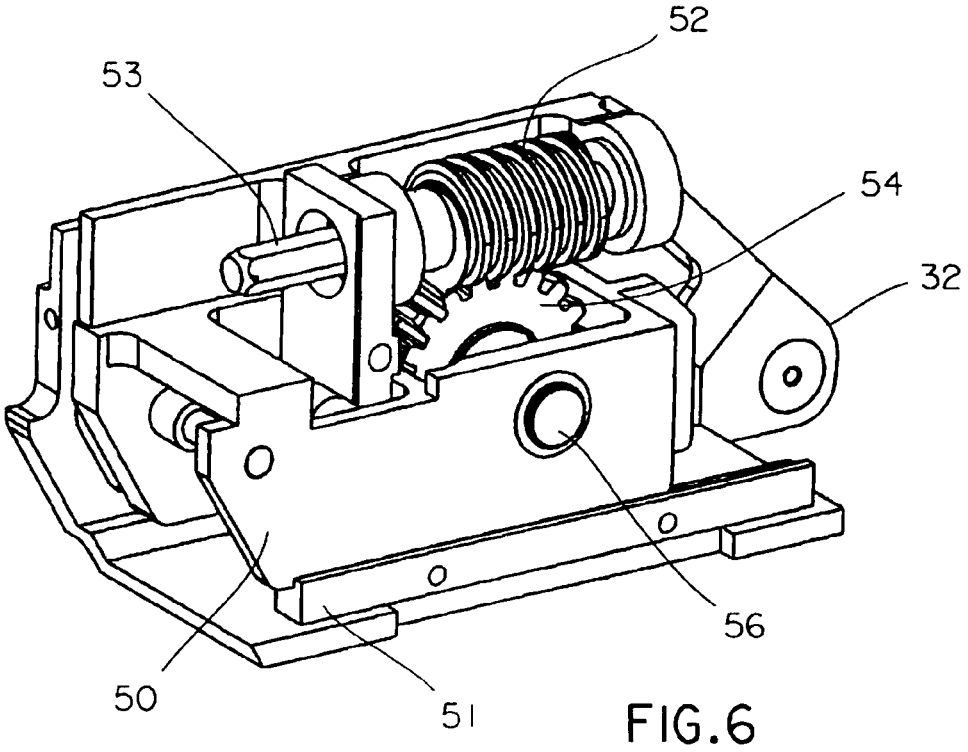
FIG. 6 is a right side perspective view of the worm mounted to the gear carrier in the power tool of FIG. 3.

As illustrated in FIGS. 3-5, the toggle link 102 is located at an end of the gear carrier 50 opposite the worm gear 54, worm gear shaft 56 and mandrel 58. The toggle link 102 includes a first end 104 and a second end 106. The first end 104 of the toggle link 102 pivots about a rod 108 that is mounted to the gear carrier 50. A torsion spring 114 is positioned on the rod 108. The second end 106 of the toggle link 102 has two rollers 110 which are free to rotate on pin 112. Both of the rollers 110 rest on a stationary plate 140 that is generally vertically orientated and attached to the tool body 30. A portion of pin 112 rests in the detent pocket 130 in the vertically extending portion 128 of the lever arm 120.

When the gear carrier 50 and toggle link 102 are in the starting position, the torsion spring 114 presses both rollers 110 against the stationary plate 140 which provides a force reduction on the pin 112 in the detent pocket 130. The toggle link 102 is limited to a minimum rotational angle of no more than six degrees with respect to the linear movement of the gear carrier 50. By limiting the angle of the toggle link 102 to no more than six degrees, or nearly in-line, with the line of force exerted by the stainless steel locking tie 220, the force is reduced and only a small component of that force is resisted by the pin 112 in detent pocket 130.

Figure 8:
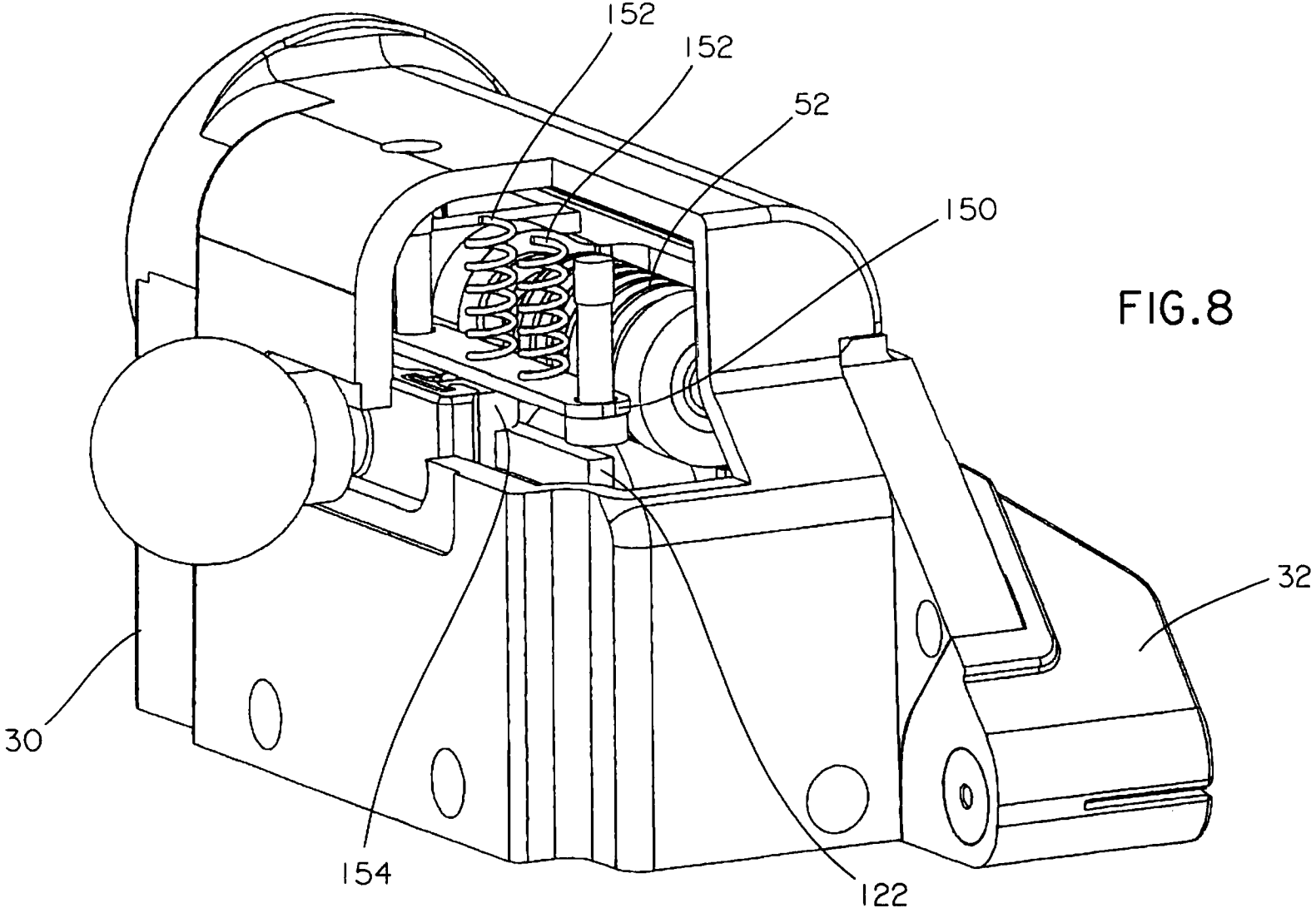
FIG. 8 is a partial right side perspective view of the tool body of FIG. 1.

As illustrated in FIG. 8, the tool body 30 also houses a spring loaded plate 150 and an actuator pin 154 for adjusting the tension setting. The actuator pin 154 is guided linearly in a slot in the tool body 30 and can be moved manually to adjust the detent force. The spring loaded plate 150 includes springs 152 that force the plate 150 to counteract the rotational force exerted by the toggle link 102 on the lever arm 120. The tension setting can be adjusted by moving the actuator pin 154 (FIG. 4) linearly along the load plate 150 thereby varying the moment arm between the lever arm pivot 126 and the point the load plate force is applied. The horizontally extending portion of the lever arm may also include a pocket 124 (see FIG. 7). The pocket 124 houses the actuator pin when it is desirable to remove the spring load from the lever arm 120.

FIGS. 9-13 illustrate the operation of the power tool of the present invention. FIGS. 9*a* and 9*b* illustrate the gear carrier 50 and the toggle mechanism 100 in a starting position before the tool 20 begins to tension the stainless steel tie 220. Once the tool is actuated, the worm 52 engages the worm gear 54 thereby rotating the worm gear 54, worm gear shaft 56 and mandrel 58. As illustrated in FIG. 9*b*, the stainless steel tie 220 has been inserted and wound on the mandrel 58. The gear carrier 50 is held in place by the toggle mechanism 100. As illustrated in FIGS. 10-13, the gear carrier 50 moves linearly toward the front of the tool as the tie 220 is tensioned around the mandrel 58 and the toggle mechanism 100 detents.

As discussed above, the torsion spring 114 presses the toggle link rollers 110 against the generally vertically orientated stationary plate 140. The orientation of the stationary plate 140 provides a force reduction on the toggle mechanism detent. The pin 112 of the toggle link 102 is positioned in the detent pocket 130 of the vertical portion 128 of the lever arm 120.

Figure 9B:
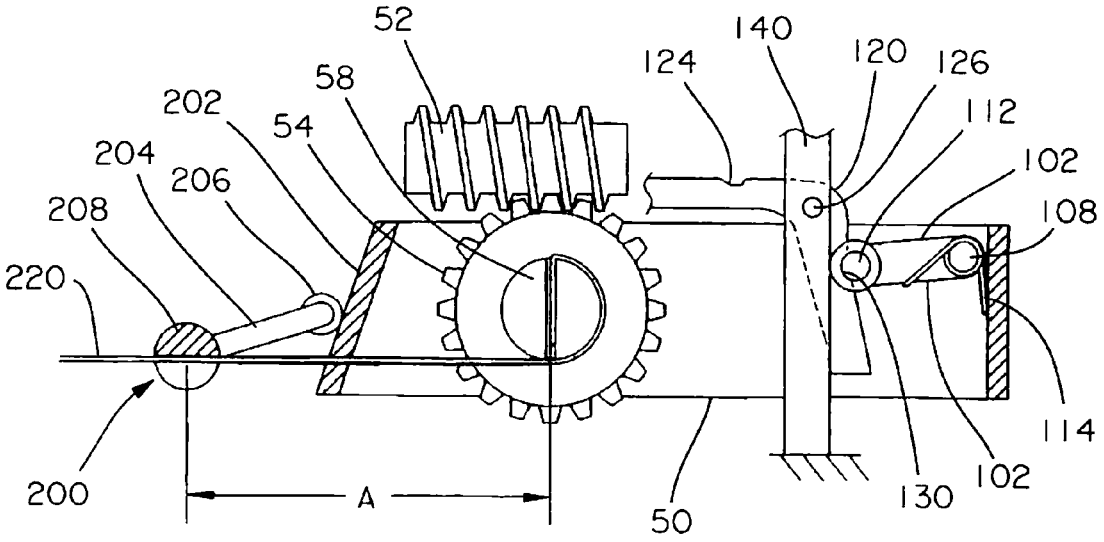
FIG. 9*b* is a side view of the gear carrier and the toggle mechanism of FIG. 9*a;*
Figure 10:
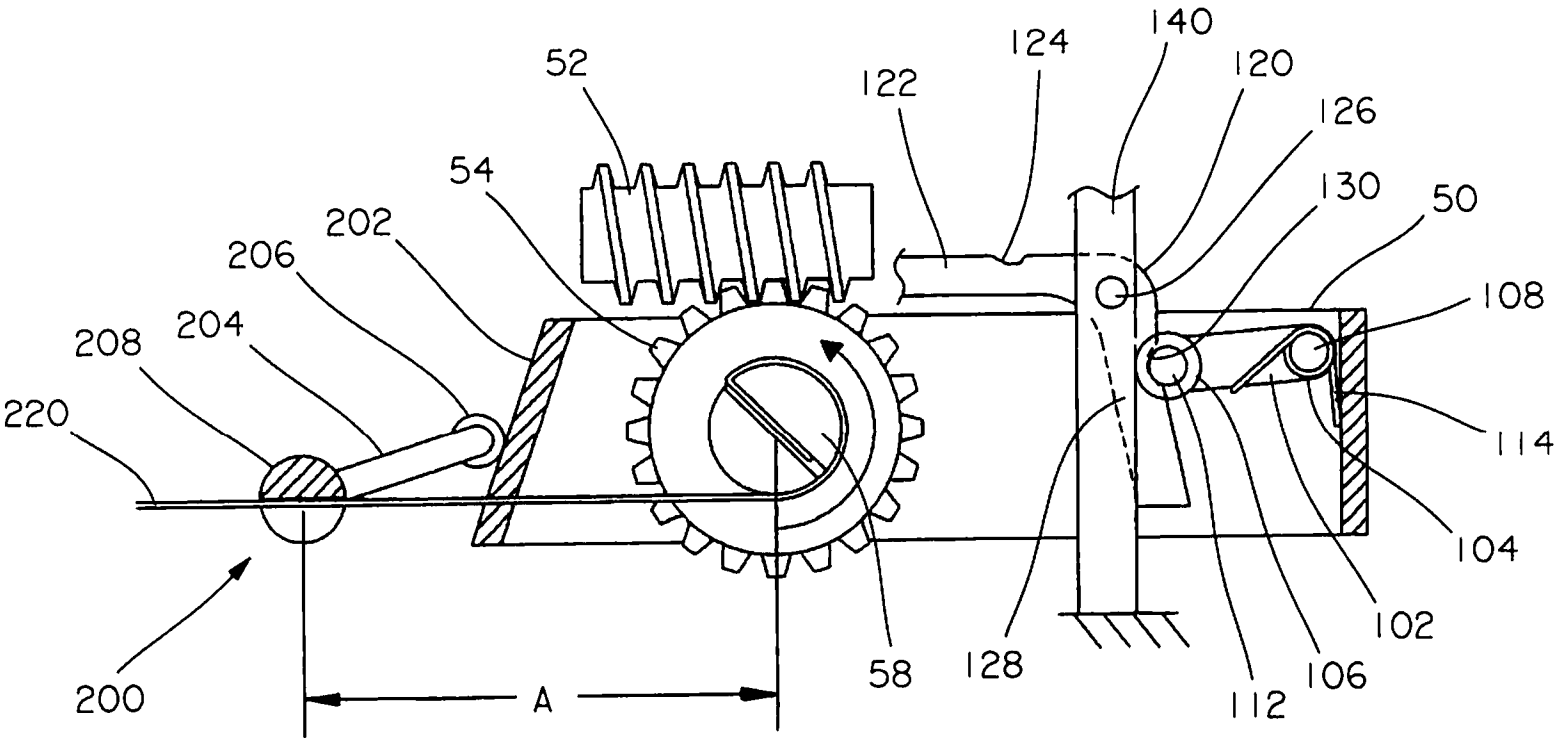
FIG. 10 is a side view of the gear carrier and the toggle mechanism of FIG. 9*a* with the mandrel beginning to wind the stainless steel tie.

As illustrated in FIGS. 9*b* and 10, the gear carrier 50 is positioned in a starting position located a distance A from the nose 32 of the tool 20. The worm 52 drives the worm gear 54 rotating the worm gear shaft 56 and mandrel 58. As the mandrel 58 rotates, it winds the stainless steel tie 220 to tension the tie 220. As the mandrel 58 tensions the tie 220, a linear force is exerted on the gear carrier 50.

Figure 11:
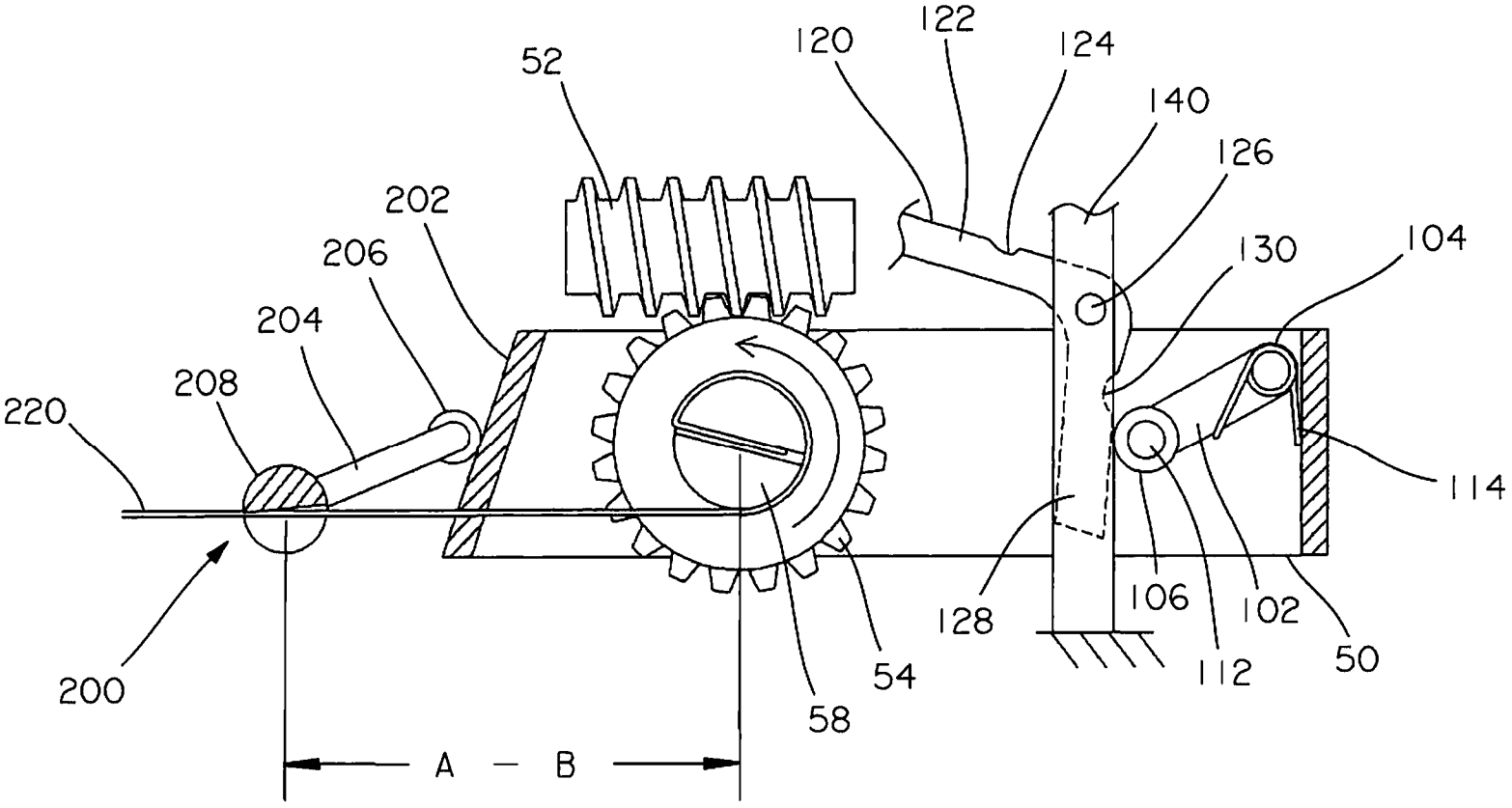
FIG. 11 is a side view of the gear carrier and the toggle mechanism of FIG. 9*a* with the detent setting of the toggle mechanism being overcome.

FIG. 11 illustrates the mandrel 58 continuing to tension the tie 220. The linear force exerted on the gear carrier 50 begins to overcome the spring load on the toggle mechanism 100. The pin 112 on the end of the toggle link 102 forces the lever arm 120 to tilt as the pin 112 detents out of the detent pocket 130 in the vertical portion 128 of the lever arm 120. As a result, the gear carrier 50 is now positioned at a distance A-B from the nose 32 of the tool 20. As the gear carrier 50 is pulled forward toward the front of the tool nose 32, the cutting mechanism 200 is actuated.

The cutting mechanism 200 is located in the nose 32 of the tool 20. As illustrated in FIGS. 9*b*-13, the cutting mechanism 200 includes a cutter 208, a cutter lever 204 and a roller 206. The cutter 208 and the roller 206 are positioned at opposite ends of the cutter lever 204. The front of the gear carrier 50 includes a ramp 202. The ramp 202 is designed to actuate the cutter 208 via the roller 206 at the opposite end of the cutter lever 204. As the gear carrier 50 is pulled forward, the roller 206 travels along the ramp 202 raising the cutter lever 204 to enable the cutter 208 to cut the tie 220.

Figure 12:
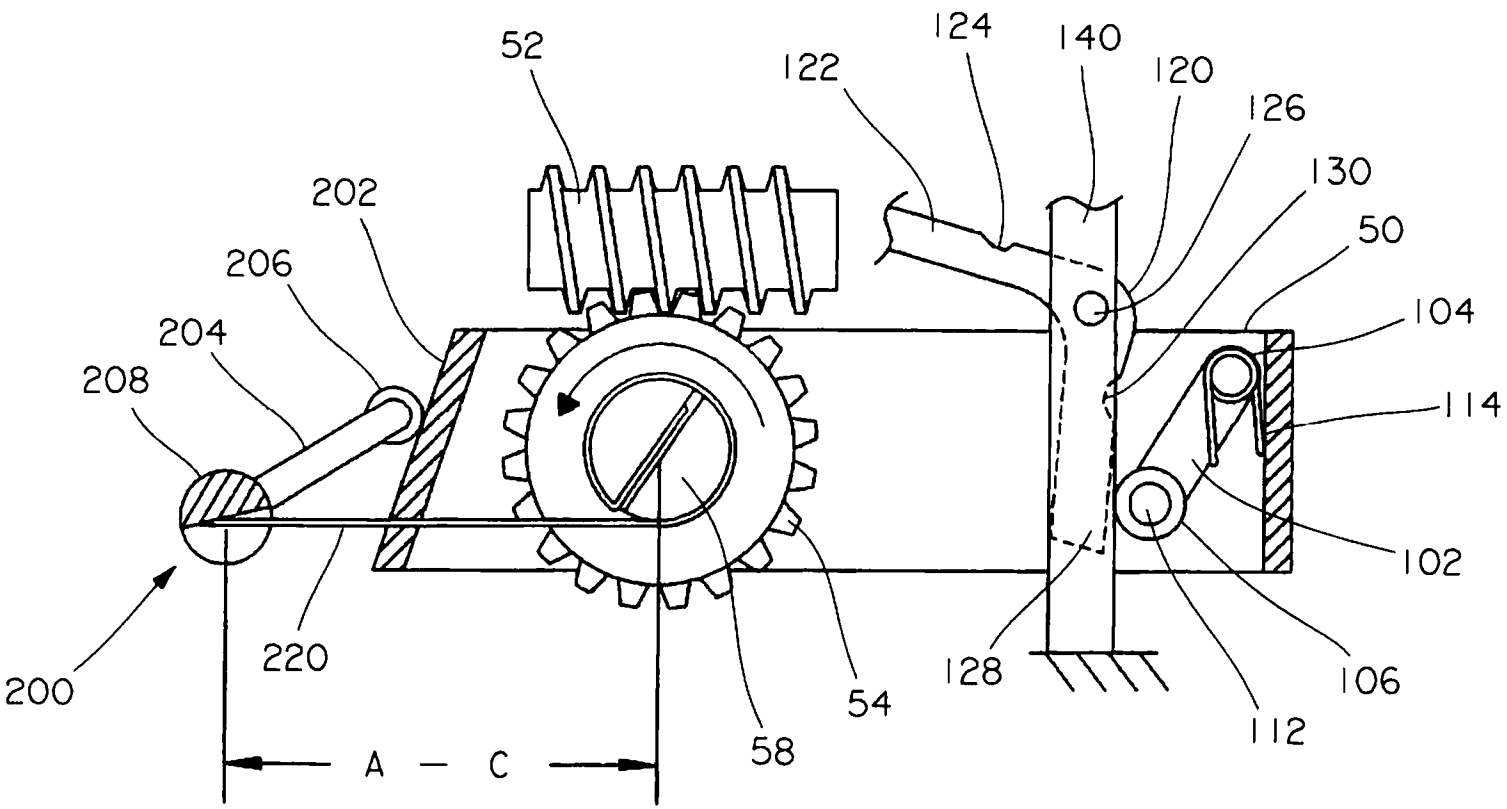
FIG. 12 is a side view of the gear carrier and the toggle mechanism of FIG. 9*a* with the tie being tensioned and the gear carrier moving forward to cut the stainless steel metal locking tie.

FIG. 12 illustrates the mandrel 58 further winding the stainless steel tie 220 and the gear carrier 50 pulled closer to the front of the tool 20 such that the gear carrier 50 is positioned at a distance A-C from the nose 32 of the tool 20. During the forward motion of the gear carrier 50, the worm gear 54 moves linearly along the worm 50. The worm gear 54 continues to move along the worm 50 until the stainless steel tie 220 is completely cut.

After the tie 220 is cut, the tensioning force which pulled the gear carrier 50 forward is removed. As a result, the torsion spring 114 is now able to rotate the toggle link 102 back to the nearly horizontal position, exerting a linear force against the stationary plate 140 and moving the gear carrier 50 back to the starting position. As the toggle link 102 rotates back to the starting position, the end of pin 112 falls back into the detent pocket 130. As the gear carrier 50 moves back to the starting position, the worm gear 54 walks back along the worm 52.

Figure 13:
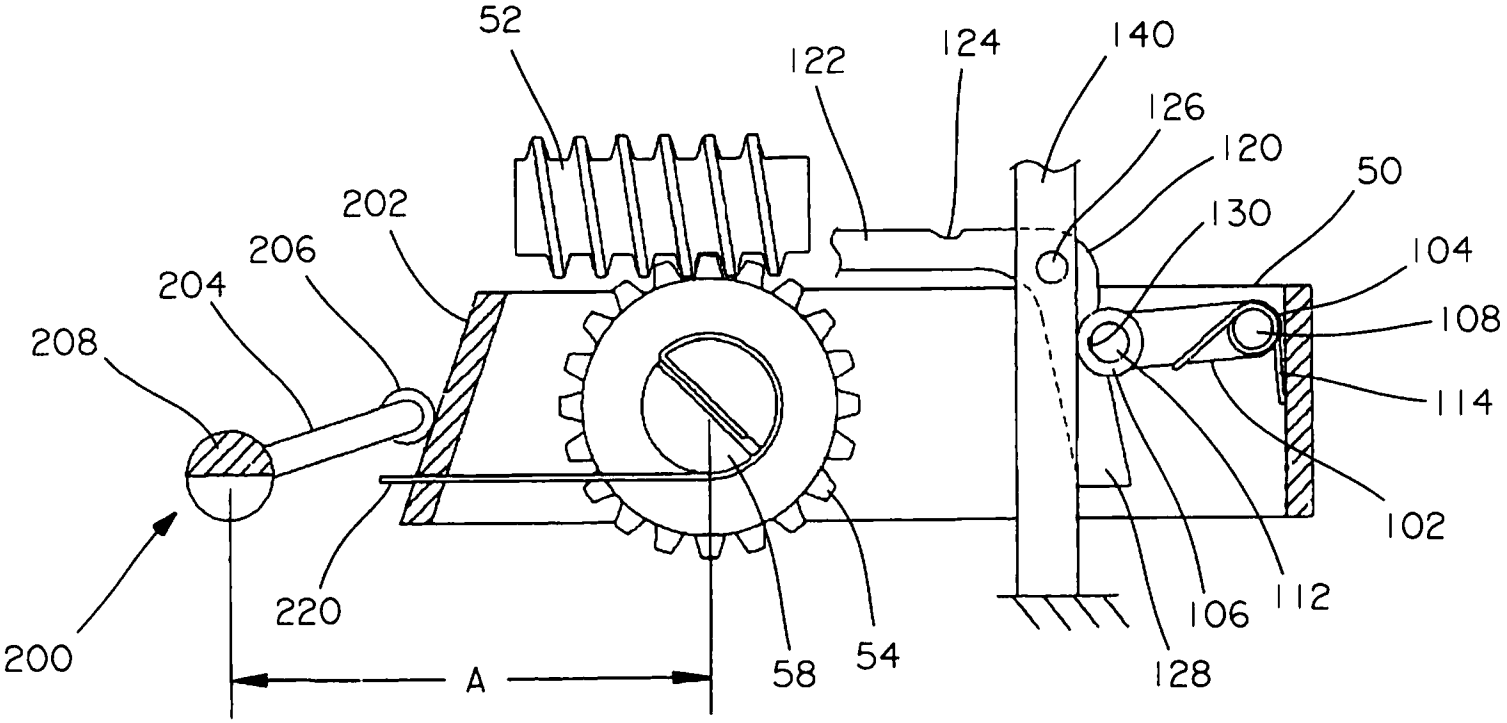
FIG. 13 is a side view of the gear carrier and the toggle mechanism of FIG. 9*a* returned to the starting position after the tie has been cut.

FIG. 13 illustrates the gear carrier 50 returned to the starting position where the gear carrier 50 is positioned at a distance A away from the nose 32 of the tool 20.

Furthermore, while the particular preferred embodiments of the present invention have been shown and described, it will be obvious to those skilled in the art that changes and modifications may be made without departing from the teaching of the invention. The matter set forth in the foregoing description and accompanying drawings is offered by way of illustration only and not as limitation. The actual scope of the invention is intended to be defined in the following claims when viewed in their proper perspective based on the prior art.

The invention claimed is:

1. A method for installing a metal locking tie using a metal locking tie tool, the tool comprising a tool body with a worm, a worm gear, a worm gear shaft, and a mandrel for tensioning the metal locking tie; a gear carrier positioned in the tool, wherein the worm gear, worm gear shaft and mandrel are mounted in the gear carrier; and a cutting mechanism engaging the gear carrier, the method comprising the steps of:

positioning the metal locking tie in the mandrel extending from the tool;

actuating the tool to begin tensioning the metal locking tie, once the tool has been actuated, the worm engages the worm gear to rotate the worm gear, worm gear shaft and mandrel;

winding the metal locking tie around the mandrel to tension the metal locking tie;

pulling the gear carrier toward a nose of the tool, wherein as the gear carrier moves linearly in the tool body toward the nose of the tool, the worm gear mounted in the gear carrier moves linearly along the worm; and actuating a cutting mechanism to cut the tensioned metal locking tie, wherein the cutting mechanism comprises a cutting lever with a roller at one end and a cutter at an opposite end, and the roller engages a ramp at a front of the gear carrier, wherein as the gear carrier moves toward the nose of the tool, the roller travels along the ramp of the gear carrier raising the cutting lever to rotate the cutter to cut the metal locking tie.

2. The method of claim 1, wherein as the mandrel tensions the tie, a linear force is exerted on the gear carrier.

3. The method of claim 1, further comprising the step of holding the gear carrier in place with a toggle mechanism until a toggle holding force has been exceeded.

4. The method of claim 3, wherein the toggle mechanism includes a toggle link engaging a lever arm.

5. The method of claim 4, wherein the lever arm includes a horizontally extending portion, a lever arm pivot and a vertically extending portion, and the vertically extending portion includes a detent for housing the toggle link.

6. The method of claim 4, wherein the toggle link includes a torsion spring.

7. The method of claim 4, wherein the toggle link is located at the end of the gear carrier opposite the worm gear, the worm gear shaft, and the mandrel.

8. The method of claim 1, wherein the cutting mechanism is located in the nose of the tool for enabling the tool to engage metal locking ties in tight locations.

9. The method of claim 1, further comprising a carrier guide positioned in the tool body, wherein the gear carrier moves within the carrier guide as the gear carrier moves linearly in the tool body.

* * * * *